US006900248B2

(12) United States Patent
Minkkinen et al.

(10) Patent No.: US 6,900,248 B2
(45) Date of Patent: May 31, 2005

(54) HIGH-PRESSURE FISCHER-TROPSCH SYNTHESIS PROCESS USING AN OPTIMIZED COOLANT

(75) Inventors: Ari Minkkinen, Saint Nom la Breteche (FR); Reynald Bonneau, Villeurbanne (FR); Jean-Marc Schweitzer, Villette de Vienne (FR)

(73) Assignees: Institut Francais du Petrole, Rueil Malmaison Cedex (FR); ENI S.p.A., Rome (IT)

( * ) Notice: Subject to any disclaimer, the term of this patent is extended or adjusted under 35 U.S.C. 154(b) by 0 days.

(21) Appl. No.: 10/650,031

(22) Filed: Aug. 28, 2003

(65) Prior Publication Data

US 2005/0049318 A1 Mar. 3, 2005

(30) Foreign Application Priority Data

Aug. 28, 2002 (FR) ..... 02 10662

(51) Int. Cl.[7] ..... C07C 27/00

(52) U.S. Cl. ..... 518/712; 700/711

(58) Field of Search ..... 518/700, 711, 518/712

(56) References Cited

U.S. PATENT DOCUMENTS 2,500,519 A * 3/1950 Clark ..... 518/712
5,409,960 A 4/1995 Stark

FOREIGN PATENT DOCUMENTS

EP 0614864 9/1994
GB 643606 9/1950

* cited by examiner

*Primary Examiner*—J. Parsa
(74) *Attorney, Agent, or Firm*—Millen, White, Zelano & Branigan, P.C.

(57) ABSTRACT

Process for synthesis of hydrocarbons by Fischer-Tropsch reaction starting from synthesis gas, operating in three-phase fluidization, the reactor having an exchanger immersed within the fluidized bed and using as coolant a fluid introduced at its boiling point at a pressure slightly greater than the pressure of the process, this boiling point being from 10 to 70° C. below the temperature of the process.

22 Claims, 3 Drawing Sheets

HIGH-PRESSURE FISCHER-TROPSCH SYNTHESIS PROCESS USING AN OPTIMIZED COOLANT

The invention relates to a Fischer-Tropsch synthesis process using a suitable coolant.

The field of the invention is that of Fischer-Tropsch syntheses, more particularly when the catalyst is used in the form of a suspension sometimes called slurry in English. The category of reactors concerned has three-phase fluidized beds in which the catalyst is divided in the form of very fine particles and is situated in the reaction medium in the form of a suspension in the liquid. The term F.T. (short for Fischer-Tropsch) reactor will be used hereinafter to describe this category of reactors. Fischer-Tropsch syntheses are characterized by a strong exothermicity of the reaction, typically of the order of 40 kcal/mol which necessitates the elimination of the heat generated by the reaction within the reaction medium itself so as to keep the reactor within certain temperature limits. In the case of the present invention, the temperature of the reaction medium is preferably between 200 and 250° C., and more particularly between 220 and 240° C. The pressure has a favourable influence on the conversion, but is best chosen relatively high for reasons of plant compactness. Within the framework of the invention, the pressure levels will be between 20 and 60 bar, and preferably between 30 and 50 bar (1 bar=$10^5$ Pa). These relatively high pressure levels will permit a saving in terms of the diameter of the reactor for a given production capacity, or an increase in the production capacity for a given reactor. Also, the synthesis gas constituting the F.T. syntheses charge, i.e. essentially a mixture of CO and $H_2$, is generally produced by a steam-reforming process or an autothermic process, i.e. combining a steam-reforming step and a partial-oxidation step. These steam-reforming or autothermic processes are currently operated at pressure levels of 40 bar or more, so that the synthesis gas is available at this pressure, and it is thus extremely useful in energy-producing terms to carry out the F.T. synthesis at a pressure level as close as possible to 40 bar. It can where appropriate be envisaged to carry out the F.T. synthesis at a higher pressure level, 50 or even 60 bar. The economic benefit of operating at these pressure levels will depend on the savings when using a F.T. synthesis reactor with a smaller diameter compared with jointly using a compressor enabling the pressure of the synthesis gas, assumed to be available at 40 bar, to be raised to the 50 or 60 bar adopted in order to carry out the F.T. synthesis.

F.T. reactors are fitted with bundles of exchange tubes conforming to proven designs such as the configuration comprising a multiplicity of tubes held in a tubular plate, the coolant circulating inside the tubes and the reaction medium being situated outside the tubes, calandria side. The present invention is not tied to a particular configuration of the exchange bundle. It comprises the proposal of a coolant range which conforms to the following specification.

The sought fluid or fluids must have a heat of vaporization sufficient not to lead to too-great coolant flow rates. From this point of view, the ideal fluid is water but, in the temperature conditions required by the process, the vaporization of the water at a maximum temperature of about 225° C., that is to say about 10° C. below the temperature of the reaction medium, corresponds to a pressure inside the tubes of about 25 bar. Where water is used as coolant, the pressure in the reaction medium cannot thus exceed this 25 bar figure, and the safety requirement set out below thus limits access to higher pressures for the process. For safety reasons, it is in fact advisable to maintain a slight pressure difference between the inside of the tubes and the reaction medium so that, should a tube of the exchange bundle rupture, the coolant passes from the inside of the tube to the reaction medium.

The coolant must also be compatible with the reaction medium and more particularly with the catalyst which, in contact with certain fluids, can lose its activity. In the case of F.T. synthesis, the catalyst used, generally based on cobalt or more generally on a group VIII metal, supported on a refractory metal oxide such as alumina, silica, aluminosilicates or a zeolite, is generally water-sensitive, more particularly in the case of alumina which alters the support of the catalyst.

The sought coolant or coolants must also have boiling points (at pressure levels which are in the range 20 to 60 bar) that are sufficiently below the temperature of the reaction medium, so that the temperature difference (called delta T in the remainder of the text) between the reaction medium and the coolant circulating inside the tubes is sufficient not to lead to too-large exchange surfaces to be installed. A delta T of at least 10° C. is necessary in this regard, and with the coolants according to the invention it will be possible to operate delta T values between 10 and 70° C. and preferably between 15 and 60° C.

A requirement that can also be added to the specification of the charges of the sought coolant is that it is advantageous that it has as high as possible a critical pressure, so that at the pressure adopted for the process the difference between the critical pressure of the fluid and the pressure of the process is such that the heat of vaporization of the considered fluid is still large. For example, in the case of methanol, the critical pressure of which is 80 bar, the heat of vaporization under 40 bar, corresponding to a boiling point of 200° C., is 148 kcal/kg. Finally, a high molecular weight of the coolant will be favourable inasmuch as this figure will be able to compensate for the reduction in heat of vaporization relative to water expressed in Kcal/mol.

European patent EP 0 614 864 proposes as coolant normal, isomerized or cyclic paraffins with carbon atom counts between 4 and 10. These hydrocarbons have boiling points between 200 and 400° C. at 30 bar and between 230 and 450° C. under 50 bar. Pentane is presented in this patent as the preferred fluid. The heat of vaporization of pentane, of the order of 50 kcal/kg, is very small and greatly penalizes the cooling system from the point of view of the coolant flow rate. Moreover, its critical pressure of 34 bar does not permit operation at a sufficiently high pressure process-side.

One of the aims of the invention is to remedy the drawbacks of the prior art and solve the technical problem posed.

More precisely, the invention relates to a process for hydrocarbons synthesis by Fischer-Tropsch reaction starting from a synthesis gas, in a reaction zone (1) containing a reaction medium comprising the said synthesis gas and a catalyst in fluidized bed and operating in three-phase fluidization, in which process a coolant is circulated in at least one heat-exchange zone (2) internal to the reaction zone and immersed within the fluidized bed, characterized in that the coolant is introduced into the heat-exchange zone (2) at a temperature close to its boiling point at the pressure of the reaction medium, this boiling point moreover being situated in a range of 10 to 70° C. below the temperature of the reaction medium, and preferably in a range of 15 to 60° C. below the temperature of the reaction medium.

The invention will be better understood in the light of the following figures, of which.

BRIEF DESCRIPTIONS OF THE INVENTION

Figure 1:
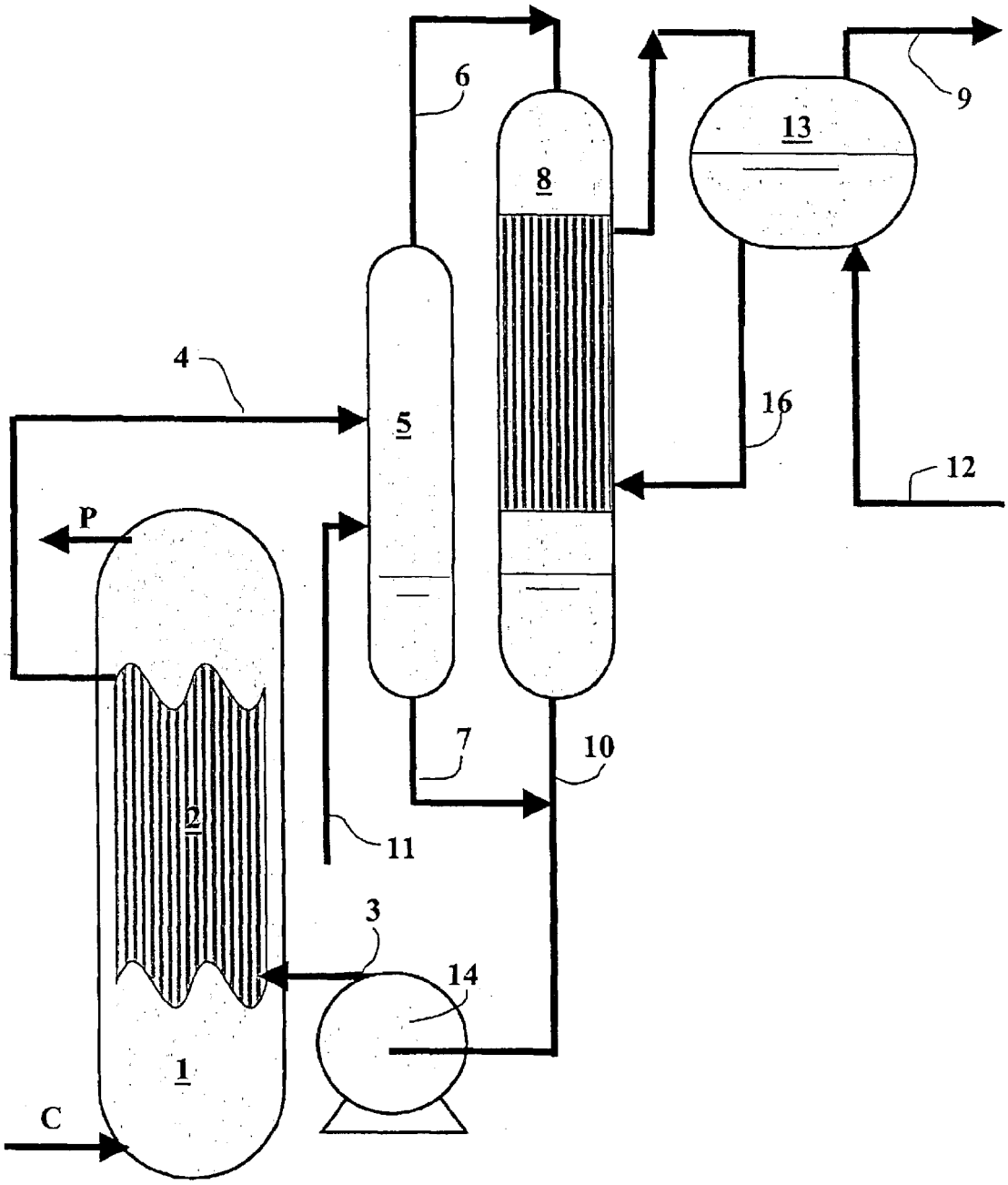
FIG. 1 is a process diagram in which the circulation of the coolant takes place in closed circuit, the cooling of the coolant being effected by an indirect exchanger permitting a generation of water vapour.

The present invention is illustrated in general by FIG. 1. It comprises the proposal of a certain type of coolant for F.T. synthesis reactors and more generally for any reactor operating in three-phase fluidization (that is to say comprising a gas phase, a liquid phase, and a solid phase constituted by the catalyst suspended within the liquid phase) and employing a strongly exothermic reaction for which it is beneficial to operate at high pressure, either because the pressure promotes the conversion or the yield of a sought product, or simply because an increase in pressure will allow a greater charge quantity to be processed for a given reactor. The said reactor has at least one exchanger immersed within the fluidized bed so as to extract calories from this fluidized bed, and the said exchanger uses a coolant characterized in that this coolant is introduced into the exchanger at a temperature close to its boiling point at the pressure of the reaction medium, this boiling point also being situated in a range running from 10 to 70° C. below the temperature of the reaction medium, and preferably in a range running from 15 to 60° C. below the said temperature of the reaction medium. The coolant can belong to the family of alcohols having a carbon atoms count of less than or equal to 3, and will preferably be methanol, ethanol or any mixture of these two compounds. In certain cases, it may be advantageous to introduce into the coolant mixture a certain proportion of water that will permit the boiling point to be more finely adjusted and an improved heat of vaporization to be enjoyed. The maximum proportion of water in this type of mixture will be 85% by weight, and preferably 70% by weight. In the case of pure methanol, the heat of vaporization at 30 bar is of the order of 200 kcal/kg and the boiling point in the range 30/50 bar changes from 185 to 212° C. Methanol can thus vaporize at a temperature several tens of degrees below the temperature of the reaction medium, typically 235° C., under a pressure for example of 40 bar, since the boiling point of methanol under 40 bar is 200° C. Methanol as coolant is thus compatible with an operation of the F.T. reactor at pressure levels of up to 60 bar. In preferred manner for Fischer-Tropsch synthesis reactors, the pressure of the reaction medium will preferably be between 30 and 50 bar and the temperature of the reaction medium will be between 200 and 250° C. and preferably between 220 and 240° C. The examples below will illustrate the advantages of methanol as a coolant compared with water. In addition, as methanol is a co-product of F.T. synthesis, any leak of coolant into the reaction medium will not have repercussions. Finally, the vaporized methanol can then be expanded in a turbine in order to effect the generation of energy. This variant is illustrated by FIG. 3. Generally, it will be preferred to preserve a relatively simple methanol loop and the methanol vaporized after the cooling of the reaction medium will be re-condensed in a different exchanger external to the reaction medium, so as to indirectly effect a generation of vapour. Finally, in certain cases where the reduction of costs is a priority, and where a coolant can be obtained cheaply and in a large quantity, such as for example for an installation situated in a floating storage and production station, the methanol can be re-condensed by simple cooling with sea water in standard equipment. This variant is illustrated by FIG. 2.

DETAILED DESCRIPTION OF THE INVENTION

The detailed description will be given with reference to the attached FIG. 1. A.F.T. reactor (1) processes a charge (C) constituted by a mixture of CO and $H_2$ called synthesis gas and produces a collection of hydrocarbons with a carbon atom count ranging from 1 to about 80, designated (P). As the reactions involved are strongly exothermic, the reactor is cooled by an exchange bundle (2) constituted by a tube assembly immersed within the fluidized reaction medium. The design of the exchange bundle is not a characteristic of the present invention which is compatible with any type of exchange bundle. This exchange bundle will be characterized by a certain exchange surface density which will generally be in the range of 10 to 30 $m^2/m^3$ of reaction volume and preferably in the range 15 to 25 $m^2/m^3$ of reaction volume. A catalyst reduced to the state of fine particles of an average diameter of about 50 microns is suspended within the liquid phase constituted by the products of the reaction, and the liquid/solid suspension is itself crossed by the gas phase present in the medium in the form of bubbles. A coolant, for example methanol, is introduced in liquid state into the lower part of the tube bundle (2) from a pump (14) via a line (3) in a state close to its bubble point, and at a pressure slightly greater than the pressure prevailing in the reaction medium. Generally, this positive pressure difference between the inside of the tubes and the reaction medium will be between 0.5 and 5 bar and preferably between 1 and 4 bar. The coolant is heated until it reaches its boiling point at the considered pressure and is partially vaporized inside the immersed tube bundle (2). The resultant liquid/vapour mixture leaves the tube bundle (2) via its upper part by means of a line (4), at a temperature about 20 to 30° below the temperature of the reaction medium and is introduced into a separating flask (5) external to the reaction medium, from which a vapour phase is extracted through a line (6) and a liquid phase through a line (7). The vapour phase (6) is introduced into an exchanger (8) which will allow its condensation in liquid evacuated through a line (10) and the line (7) of the resultant liquid phase, that has come from the separating flask (5), also joins this liquid-phase line (10). The liquid phase of the line (10) is taken up by the pump (14) which will pass the coolant through the line (3) into the tube bundle (2) of the reactor (1). The pump (14) which will pass the coolant through the line (3) into the tube bundle (2) of the reactor (1). The pump (14) compensates for the pressure drop due to the traversal of the tube bundle (2) and imparts a sufficient speed to the coolant so as to increase tube-side heat-exchange coefficients. The addition of methanol, or more generally of coolant, is realized by a line (11) which discharges into the liquid phase of the separating flask (5). Generally, the exchanger (8) will be an exchanger with a tube bundle and calander, the coolant to be condensed circulating inside the tubes, and the cooling fluid allowing this condensation being situated calander-side. The calander-side cooling fluid will generally be liquid water which will use the heat of condensation of the coolant to change into a water/vapour mixture. The water/vapour circuit can be of the gas siphon type, that is to say employing a separating flask (13) placed high enough relative to the exchanger (8) for the circulation of the water/vapour mixture between the exchanger (8) and the flask (13) through a line (15) to take place solely through gravity, and the circulation of the liquid water originating in the flask (13) to the exchanger (8) through a line (16). The saturated vapour leaves the flask (13) through a line (9) at a temperature about 10° C. below that of the coolant. The liquid water is added through a line (12) which enters the lower part of the flask (13).

Figure 2:
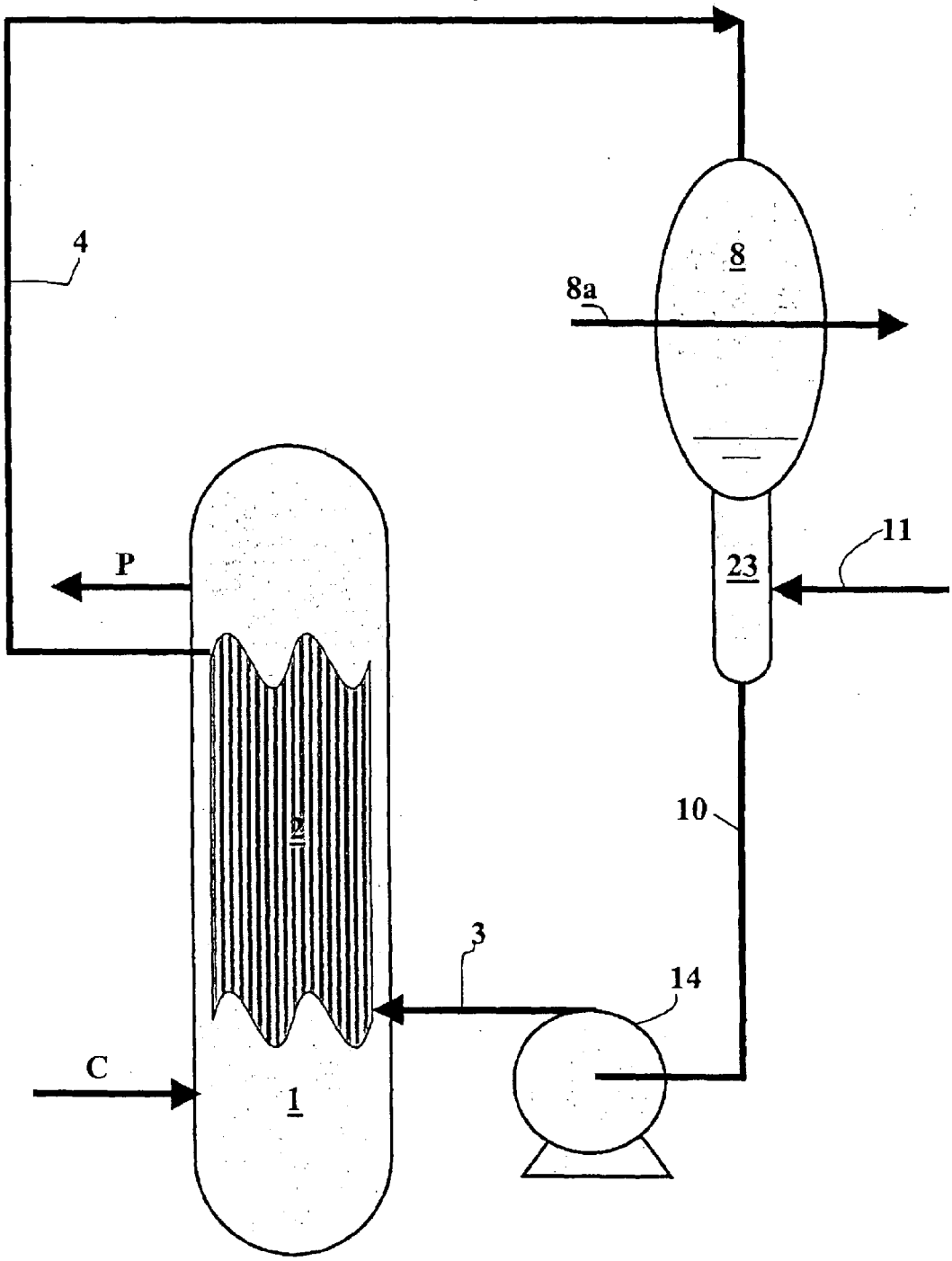
FIG. 2 is a variant of the process diagram in which the circulation of the coolant still takes place in closed circuit, the cooling of the coolant being effected indirectly by a simple air-coolant or a lost-water circulation.
Figure 3:
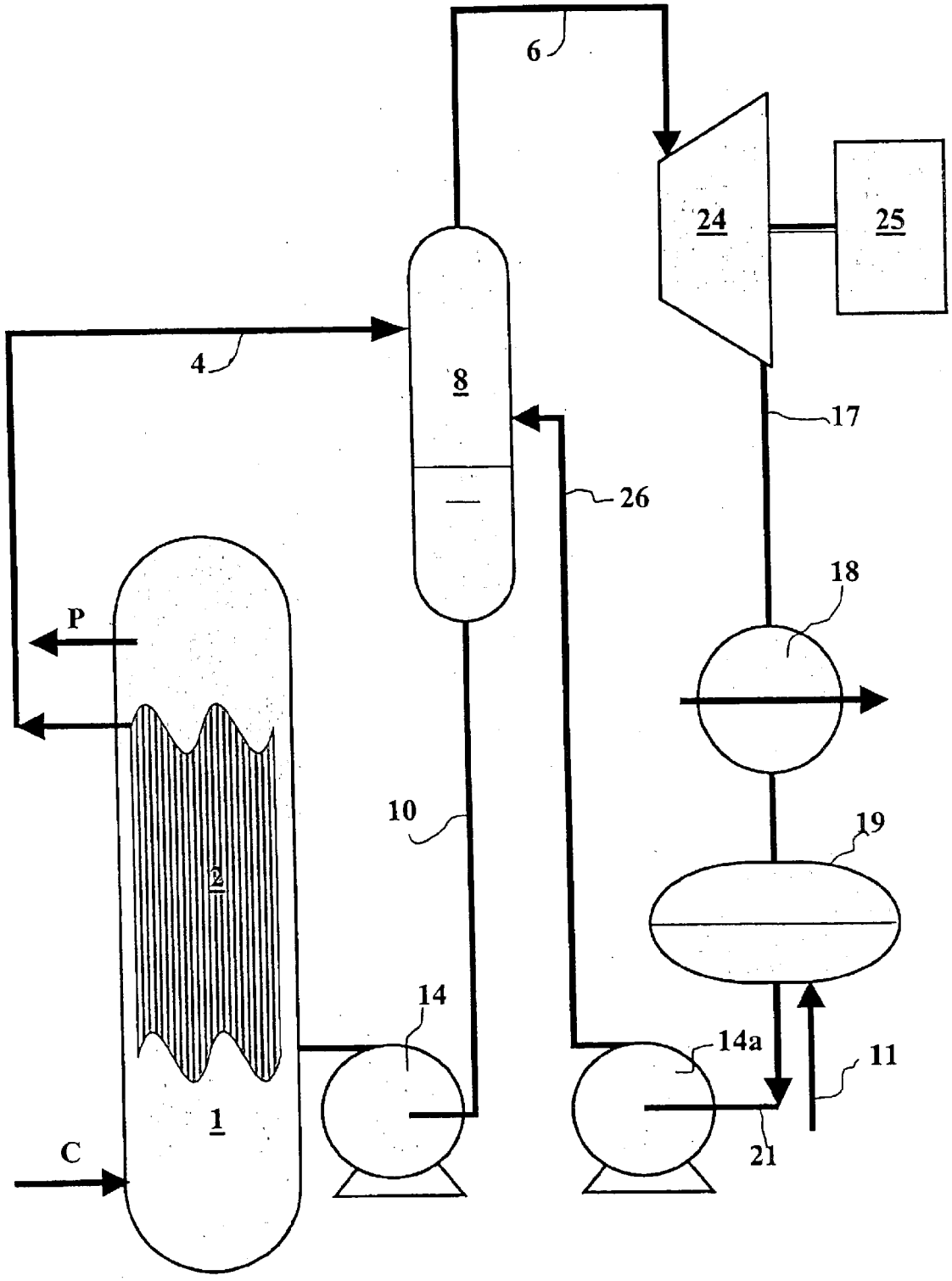
FIG. 3 is a variant of the process diagram in which the circulation of the coolant still takes place in closed circuit, the cooling of the coolant which comprises a system of energy recovery by expansion in a turbine being effected in part by this expansion, and in part by direct heat exchange.

In a variant of the invention corresponding to a situation where a cooling fluid can be obtained in a large quantity and at low cost, the circuit represented by FIG. 1 can be simplified in order to arrive at the circuit represented in FIG. 2. The cooling fluid is the fluid permitting condensation of the coolant, the subject of the invention, at the exchanger (8). This is for example the case when the F.T. installation is built on the seashore. In this case, the circuit of the coolant is simplified and at the outlet from the exchange bundle (2), the liquid/vapour mixture is sent into the exchanger (8) in which a cooling fluid **(8*a*) operating in ambient temperature and pressure conditions will be for example sea water. In another variant, the cooling fluid can even be ambient air, the exchanger (8) becoming in this case an aero-coolant. In this simplified version, there is no need for the separating flask (5) placed upstream from the exchanger (8) inasmuch as the liquid/vapour mixture of the coolant is sent calander-side into the exchanger (8), and no longer just the vapour phase of this fluid which was sent tube-side into the exchanger (8) in the previous case. The liquid phase of the coolant (10) is extracted from the exchanger (8) by an appendage (23) situated in the lower part of the said exchanger (8). This liquid phase is reintroduced into the immersed exchange bundle (2) of the reactor (1) by means of the pump (14) via the line (3). In these different variants, the circuit of the coolant, for example methanol, remains absolutely unchanged and the meaning of the equipment (1); (2); (3); (4) appearing in FIG. 2 is exactly the same as in FIG. 1. In particular the line (11)** still designates the line supplying coolant.

In a second variant illustrated by FIG. 3, the energy due to the pressure of the coolant is recovered on the vapour line (6) by means of a turbine or a turbo-expander (24) which will expand the vaporized part of the coolant, up to a suitable lower pressure level, where the said part will be in the form of a liquid/vapour mixture leaving the turbine (24) through a line (17). The turbine (24) can be used to operate a generating set (25) or any other energy generator. The liquid/vapour mixture is expanded after passing into the turbine (24) to a pressure level at which it is possible to condense the methanol remaining in vapour phase at ambient temperature. The liquid/vapour mixture is totally condensed in an exchanger (18), and the resulting liquid is introduced into a separating flask (19) whence a liquid is extracted through a line (21) which is taken by a pump **(14*a*) in order to be returned into the flask (8) by means of a line (26). From the flask (8), the coolant then re-enters the exchange bundle (2) through the line (10) by means of the pump (14). The line (11) designates the line supplying refrigerant, which can take place at the flask (19)** as shown or at the condenser.

One aspect of the invention can be emphasized as regards the existence for the reactor of stable operating points and unstable operating points. By operating point of the reactor is meant a stationary point corresponding to the equality of the heat produced by the chemical reaction (CR) and of the heat evacuated through the cooling system (HE). These two quantities of heat are functions of the temperature, and it can be shown in the case of a reactor assumed to be fully stirred and a chemical kinetic reaction presenting a substantial activation energy that the intersection of the curve representing the heat produced (CR) and the heat extracted (HE) can take place at several points, some of which are called stable and others unstable. Stable points are those for which a small difference in temperature around the said point will be naturally absorbed so that the operation of the reactor will again be on the original operating point, even in the absence of any system of control and regulation. On the other hand, the points called unstable are those for which a small difference in temperature around the operating point will be amplified, so that the operation of the reactor will move away from the original point to become established at a new separate operating point, and sometimes very far away from the original point, this new operating point being generally stable in the sense defined above. Depending in particular on the temperature difference (delta T) between the reaction medium and the wall of the tubes of the exchange bundle (2), it may happen that the resulting operating point is unstable in the sense defined previously. This situation can be very harmful inasmuch as it can lead to a departure from the temperature operating window, which is relatively narrow in the case of F.T. synthesis. To avoid this situation, the first measure is to reduce the value of delta T, which will lead in certain limit cases to exchange surfaces to be installed which may be too large given the volume of the reactor. To remedy this latter situation, it will then be desirable, and sometimes essential, to incorporate in the reactor a command control system known as dynamic control which will permit remaining on the chosen operating point, even if the latter is unstable. A description of such a command control system will be found in the article "An Analysis of Chemical Reactor Stability and Control" by N. R. Amundson and R. Aris published in the journal Chemical Engineering Science, pages 7 to 121 in 1958. Such a command control system can be used if necessary if the obtained operating point was an unstable point. It should be emphasized however that the inherent dynamics of reactors with a suspended catalyst for F.T. synthesis lend themselves well to this type of command control inasmuch as the reaction medium has a very stirred character, and the transmission of the disturbances thus takes place at high speed. In particular, a temperature variation in the reaction medium can be very quickly detected by a suitable temperature sensor, situated within this medium, and the corrective action, for example on the pressure of the coolant or on its flow rate, can thus itself be triggered very quickly from a suitable control and command organ.

EXAMPLES

Presented below are 5 operating examples of a F.T. synthesis reactor processing a $CO+H_2$ mixture intended to effect the synthesis of a very wide range of hydrocarbons ranging from methane to compounds having up to 80 carbon atoms. The flow rate of hydrocarbons leaving the reactor is 36.5 tonnes/hour. The diameter of the reactor is 5 meters and the temperature of the reaction medium is 235° C. The results are presented in table I below.

Example 1 is representative of the state of the art and uses water as coolant. The pressure of the reaction zone is 20 bar. The reactor is fitted with an internal exchanger, the surface exchange of which is 9400 $m^2$ permitting the dissipation of 100 Gcal/hour (1 Gcal=$10^9$ cal, 1 cal=4.18 joules), corresponding to the heat of reaction. The pressure inside the tubes of the exchange bundle is 21 bar so as to maintain a positive difference between the inside of the tubes and the reaction medium.

Examples 2, 3 and 4 correspond to the invention and use methanol as coolant. The three values that were kept constant vis-à-vis Example 1 are the temperature of the reaction medium (235° C.), the heat to be extracted from the reactor (100 Gcal/h) and the pressure difference of 1 bar between the inside of the tubes and the reaction medium.

Example 2 is characterized by a reaction zone pressure that is identical to that of Example 1, namely 20 bar. It will be seen that, because of the temperature difference between the reaction medium and the tubes of the exchanger (which is called delta T hereinafter) which changes from 20° C. with water to 67° C. with methanol, the exchange surface in the methanol case is much smaller than it was with water (3600 $m^2$ as against 9400 $m^2$).

Example 3 is characterized by a reaction zone pressure of 30 bar, a choice which will mean an improvement in the conversion and permit, for a given reactor, the processing of a greater charge quantity. The delta T is smaller than in Example 2, but still leads to an exchange surface that is smaller than that of Example 1 (5000 $m^2$ as against 9400 $m^2$).

Example 4 is characterized by a reaction zone pressure of 40 bar which corresponds to the pressure levels at which it is wished to operate the reactor. The delta T is reduced to 34° C. but still leads to an exchange surface that is smaller than that corresponding to Example 1 (7100 $m^2$ as against 9400 $m^2$).

Example 5, still with a pressure of 40 bar and a temperature of 235° C. in the reaction zone, illustrates the fact that the methanol mixed with the water permits a reduction of the delta T between the reaction medium and the coolant such, where necessary, as to be situated on a stable operating point. With a proportion of 60% water and 40% methanol by weight, a water/methanol mixture is realized of which the average boiling point is 220° C., which permits operation with a delta T of 15° C. and thus the ensuring of the stability of the operating point. The exchange surface to be introduced in this case is 13900 $m^2$.

Examples 2, 3 and 4 show that the choice of methanol as coolant allows the pressure of the reaction zone to be increased while reducing the surface of the exchanger. It must also be emphasized that in the case of a rupture of one of the tubes of the exchange bundle, as the leak is from the tubes to the reaction medium because of the positive pressure difference imposed in this direction, the medium will be charged with methanol which is not a troublesome fluid from the safety point of view as it is part of the products of the reaction.

In general, the boiling point of the coolant is 165–225° C., preferably 195–215° C. at a pressure equal to the operating pressure of the reactor.

The preceding examples can be repeated with similar success by substituting the generically or specifically described reactants and/or operating conditions of this invention for those used in the preceding examples.

The entire disclosure of applications, patents and publications, cited herein and of corresponding French application no. 02/10662 filed Aug. 8, 2002.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. In a process for synthesis of hydrocarbons comprising conducting a Fischer-Tropsch reaction starting from a synthesis gas, in a reaction zone (1) containing a reaction medium at a predetermined pressure and temperature, said reaction medium comprising said synthesis gas and a catalyst in a fluidized bed and operating in three-phase fluidization, and a boilable coolant is circulated in at least one heat-exchange zone (2) internal to the reaction zone and immersed within said fluidized bed, the improvement wherein the boilable coolant is introduced into the heat-exchange zone (2) at a temperature close to the boiling point of said coolant at the pressure of the reaction medium, said boiling point being in a range of 10 to 70° C. below the temperature of the reaction medium.

2. A process for hydrocarbons synthesis according to claim 1 wherein the pressure of the reaction medium is between 20 and 60 bar, bar, and the temperature of the reaction medium is between 200 and 250° C.

3. A process for hydrocarbons synthesis according to claim 1 wherein the coolant used in the heat-exchange zone (2) comprises methanol, ethanol or mixtures thereof.

4. A process for hydrocarbons synthesis according claim 1, wherein the coolant introduced in the heat-exchange zone (2) comprises water in a proportion of less than 85% by weight of said coolant.

5. A process for hydrocarbons synthesis according to claim 1 wherein the heat-exchange zone (2) comprises an immersed heat exchanger comprising a tube bundle having a heat exchange surface density, between 10 and 30 $m^2/m^3$.

6. A process for hydrocarbons synthesis according to claim 1 wherein the coolant is introduced at least in part in the liquid state into the heat-exchange zone (2) and is partially vaporized in said zone, the resultant vapor is condensed at least in part in at least one condensation zone (8), and the liquid phase resulting from the said condensation is recycled at least in part into the heat-exchange zone (2).

TABLE I

| Nature of the coolant | Water (Ex 1) | Methanol (Ex 2) | Methanol (Ex 3) | Methanol (Ex 4) | Methanol + water (Ex 5) |
|---|---|---|---|---|---|
| Pressure of the coolant (bar) | 21 | 21 | 31 | 41 | 41 |
| Operating pressure of the reactor (process side) (bar) | 20 | 20 | 30 | 40 | 40 |
| Temperature of the reaction medium (° C.) | 235 | 235 | 235 | 235 | 235 |
| Δt between coolant side and process side (° C.) | 20 | 67 | 48 | 34 | 15 |
| Heat exchanged (Gcal/h) | 100 | 100 | 100 | 100 | 100 |
| Estimated exchange surface ($m^2$) | 9400 | 3600 | 5000 | 7100 | 13900 |
| Vaporized fluid flow rate (t/h) | 223 | 521 | 588 | 667 | 328 |

7. A process according to claim 6 wherein the condensation zone (8) comprises a liquid/vapour separation zone (5), the partially vaporized coolant is passed into the separation zone (5), a gas phase (6) is recovered which is condensed in the condensation zone (8), and a liquid phase (7) which is recycled with the liquid phase originating in the zone (8) into the heat-exchange zone (2).

8. A process according claim 7 wherein the coolant-condensing zone (8) comprises a tube bundle using water as coolant, a vapour phase of which, extracted at the top of the said tube bundle, is condensed in a separation zone (13) situated above the condensation zone (8), and a liquid phase of which is drawn off from the separation zone (13) and recycled into the tube bundle of the condensation zone (8).

9. A process according to wherein claim 7 further comprising expanding a vapour phase of the coolant recovered from the separation zone (5) in at least one turbine (24), subjecting the thus-expanded liquid/vapour mixture cooling and condensation; separation the liquid phase of the thus-obtained coolant and recycling the separated liquid phase into the condensation zone (8).

10. A process according to claim 1 wherein the temperature of the reaction medium is controlled by means of a dynamic control system acting on the pressure or on the flow rate of the coolant, so as to remain on the chosen operating point.

11. A process according to claim 1 wherein said boiling point is 15 to 60° C. below the temperature of the reaction medium.

12. A process according to claim 2 wherein the pressure of the reaction medium is between 30 and 50 bar and the temperature of the reaction medium is between 220 and 240° C.

13. A process according to claim 4 wherein the coolant comprises less than 70% by weight of water.

14. A process for hydrocarbons synthesis according to claim 2, wherein the coolant used in the heat-exchange zone (2) comprises methanol, ethanol or mixtures thereof.

15. A process for hydrocarbons synthesis according to claim 4, wherein the coolant used in the heat-exchange zone (2) comprises methanol, ethanol or mixtures thereof.

16. A process for hydrocarbons synthesis according to claim 11, wherein the coolant used in the heat-exchange zone (2) comprises methanol, ethanol or mixtures thereof.

17. A process for hydrocarbons synthesis according to claim 12, wherein the coolant used in the heat-exchange zone (2) comprises methanol, ethanol or mixtures thereof.

18. A process for hydrocarbons synthesis according to claim 13, wherein the coolant used in the heat-exchange zone (2) comprises methanol, ethanol or mixtures thereof.

19. A process for hydrocarbons synthesis according to claim 1, wherein said boiable coolant circulated in at least one heat-exchange zone (2) is at a pressure greater than the pressure of the reaction medium.

20. A process for hydrocarbons synthesis according to claim 19, wherein said boilable coolant is at a pressure between 0.5 and 5 bar higher than the pressure of the reaction medium.

21. A process for hydrocarbons synthesis according to claim 19, wherein said boilable coolant is at a pressure between 1 and 4 bar higher than the pressure of the reaction medium.

22. A process for hydrocarbons synthesis according to claim 21, wherein the coolant used in the heat-exchange zone (2) comprises methanol, ethanol or mixtures thereof.

* * * * *